US009543727B2

(12) United States Patent
Taylor

(10) Patent No.: US 9,543,727 B2
(45) Date of Patent: Jan. 10, 2017

(54) NEST DIES, INDENT CRIMP DIE SETS, AND CRIMP TOOLS HAVING SUCH DIE SETS

(71) Applicant: Hubbell Incorporated, Shelton, CT (US)

(72) Inventor: Evan Seth Taylor, Columbus, MS (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/839,224

(22) Filed: Aug. 28, 2015

(65) Prior Publication Data

US 2016/0064886 A1 Mar. 3, 2016

Related U.S. Application Data

(60) Provisional application No. 62/043,639, filed on Aug. 29, 2014.

(51) Int. Cl.

| | |
|---|---|
| ***B21D 15/06*** | (2006.01) |
| ***H01R 43/058*** | (2006.01) |
| ***H01R 43/042*** | (2006.01) |
| ***B25B 7/10*** | (2006.01) |
| ***B25B 7/02*** | (2006.01) |

(52) U.S. Cl.

CPC ..... *H01R 43/058* (2013.01); *B25B 7/02* (2013.01); *B25B 7/10* (2013.01); *H01R 43/042* (2013.01)

(58) Field of Classification Search

CPC ..... H01R 43/042; H01R 43/058; B25B 7/02; B25B 7/10

USPC ..... 72/409.13, 409.14

See application file for complete search history.

(56) References Cited

U.S. PATENT DOCUMENTS

| | | | | | |
|---|---|---|---|---|---|
| 2,829,549 | A | * | 4/1958 | Demler | H01R 43/042 29/243.57 |
| 3,098,517 | A | | 7/1963 | Zell | |
| 3,504,417 | A | * | 4/1970 | Filia | H01R 43/042 29/751 |
| 3,523,351 | A | | 8/1970 | Filia | |
| 3,800,584 | A | * | 4/1974 | Edwards, Sr. | H01R 43/042 29/751 |
| 3,931,671 | A | | 1/1976 | Dittmann | |
| 4,630,462 | A | * | 12/1986 | Wiener | H01R 43/042 29/751 |
| 4,974,314 | A | | 12/1990 | Nickerson | |
| 4,991,289 | A | | 2/1991 | French | |
| 5,421,186 | A | | 6/1995 | Lefavour | |

(Continued)

OTHER PUBLICATIONS

Search Report from corresponding International Application No. PCT/US2015/047479 dated Jan. 29, 2016.

(Continued)

*Primary Examiner* — David B Jones

(74) *Attorney, Agent, or Firm* — Ohlandt, Greeley, Ruggiero & Perle, L.L.P.

(57) ABSTRACT

A nest die for mechanically securing an electrical connector to a conductor wire is provided. The nest die includes a conductor receipt area and a lip. The receipt area has an outer periphery and a bottom surface. The lip is at the outer periphery of the receipt area. The outer periphery is sufficient to receive a free end of the conductor wire abutting the bottom surface and a lower face of the electrical connector on the lip. In this manner, the nest die can be used to easily and reproducibly seat the electrical connector in the die at a predetermined position on the conductor wire.

20 Claims, 9 Drawing Sheets

(56) References Cited

U.S. PATENT DOCUMENTS

| | | | | |
|---|---|---|---|---|
| 5,435,167 | A * | 7/1995 | Holliday | H01R 43/042 29/751 |
| 5,775,158 | A | 7/1998 | Hensley | |
| 5,983,489 | A * | 11/1999 | Jee | B25B 27/10 29/751 |
| 6,101,862 | A | 8/2000 | Rzasa | |
| 6,227,030 | B1 | 5/2001 | Lefavour | |
| 6,272,738 | B1 * | 8/2001 | Holliday | B25B 7/02 29/751 |
| 6,768,059 | B1 | 7/2004 | Lefavour | |
| 6,769,173 | B2 | 8/2004 | Chadbourne | |
| 7,165,436 | B2 | 1/2007 | Bitz | |
| 7,762,117 | B2 | 7/2010 | Faucher | |
| 8,001,822 | B2 | 8/2011 | Chadbourne | |
| 2009/0255319 | A1 | 10/2009 | Sokol | |
| 2010/0319191 | A1 | 12/2010 | Hofmann | |

OTHER PUBLICATIONS

Written Opinion from corresponding International Application No. PCT/US2015/047479 dated Jan. 29, 2016.

* cited by examiner

NEST DIES, INDENT CRIMP DIE SETS, AND CRIMP TOOLS HAVING SUCH DIE SETS

CROSS REFERENCE TO RELATED APPLICATIONS

This application claims the benefit of U.S. Provisional Application Ser. No. 62/043,639 filed Aug. 29, 2014, the contents of which are incorporated by reference herein.

BACKGROUND

1. Field of the Disclosure

The present disclosure is related to nest dies for crimping connectors onto conductor wires. More particularly, the present disclosure is related to indent crimp die sets for mechanically securing electrical connectors to a conductor wire or bundle of conductor wires, as well as tools having such die sets.

2. Description of Related Art

Crimp tools, often hydraulically and/or electrically driven, are known and are generally used to mechanically secure a connector to conductor wires via compression or deformation (hereinafter "crimp" or "crimping") the electrical connector onto the conductor wires.

The crimping tools typically have a working head with a stationary crimp die and a movable crimp die, where the movable crimp die is operatively connected to a movable ram. In use, the electrical connector having the conductor wires therein is placed between the crimp die set and the movable ram is actuated so as to compress the electrical connector between the dies, to crimp the electrical connector onto the conductor wires. The crimp die sets can provide a circular crimp to the electrical connector, namely can deform the connector around its circumference. Alternately, the crimp die sets can provide an indent crimp, namely can deform the connector in a central location of one side of the connector.

The use of many prior art crimp tools have proven difficult due to the need to assemble the electrical connector at a desired location on the conductor wires and to maintain the desired location while locating that pre-crimped assembly in a desired location with the crimp die set.

Accordingly, it has been determined by the present disclosure that there is a continuing need for crimp die sets, crimp tools using such crimp die sets, and crimping methods that overcome, alleviate, and/or mitigate one or more of the aforementioned and other deleterious effects of the prior art.

SUMMARY

It has been determined by the present disclosure that the ease and repeatability with which the electrical connector can be placed on the conductor wires can be improved by the use of nest dies and crimp die sets having the structure disclosed herein, as well as tools using such dies.

A nest die for mechanically securing an electrical connector to a conductor wire is provided. The nest die includes a conductor receipt area and a lip. The area has an outer periphery and a bottom surface. The lip is at the outer periphery of the area. The outer periphery is sufficient to receive a free end of the conductor wire abutting the bottom surface and a lower face of the electrical connector on the lip. In this manner, the nest die can be used to easily and reproducibly seat the electrical connector in the die at a predetermined position on the conductor wire.

In some embodiments, a nest die for mechanically securing an electrical connector to a conductor wire using a crimp tool with a crimp axis is provided. The nest die includes conductor receipt area and a lip. The conductor receipt area has an outer periphery and a bottom surface. The lip is at the outer periphery of the conductor receipt area. The outer periphery is sufficient to receive a free end of the conductor wire abutting the bottom surface and a lower face of the electrical connector on the lip.

In some embodiments alone or in combination with the afore or aft mentioned embodiments, the conductor receipt area is configured so that the electrical connector can be loaded and unloaded from the conductor receipt area along the crimp axis and along an axis defined by the conductor wire.

In some embodiments alone or in combination with the afore or aft mentioned embodiments, the nest die further includes a positive depth from the lip to the bottom surface so that the bottom surface acts as a travel stop that sets a predetermined position with the free end of the conductor wire extending past the lower face of the electrical connector.

In some embodiments alone or in combination with the afore or aft mentioned embodiments, the positive depth is along an axis defined by the conductor wire and/or is sufficient so that a center of the electrical connector is directly in line with the crimp axis.

In some embodiments alone or in combination with the afore or aft mentioned embodiments, the nest die further includes a negative depth from the lip to the bottom surface so that the bottom surface acts as a travel stop that sets a predetermined position with the free end of the conductor wire recessed into the electrical connector with respect to the lower face.

In some embodiments alone or in combination with the afore or aft mentioned embodiments, the negative depth is along an axis defined by the conductor wire and/or is sufficient so that a center of the electrical connector is directly in line with the crimp axis.

In some embodiments alone or in combination with the afore or aft mentioned embodiments, the lip is flush with the bottom surface so that the bottom surface acts as a travel stop that sets a predetermined position with the lower face of the electrical connector flush to the free end of the conductor wire.

In some embodiments alone or in combination with the afore or aft mentioned embodiments, the conductor receipt area is configured so that the conductor wire, when the free end of the conductor wire is abutting the bottom surface, is perpendicular to the crimp axis.

An indent crimp die set for mechanically securing an electrical connector to a conductor wire using a crimp tool having a crimp direction is also provided. The die set includes a nest die and an indentor die. The nest die has a conductor receipt area and a lip, the receipt area having an outer periphery and a bottom surface, the lip being defined at the outer periphery of the receipt area, the outer periphery being sufficient to receive a free end of the conductor wire abutting the bottom surface and a lower face of the electrical connector on the lip In some embodiments alone or in combination with the afore or aft mentioned embodiments, the conductor receipt area is configured so that the electrical connector can be loaded and unloaded from the conductor receipt area along the crimp axis and along an axis defined by the conductor wire.

In some embodiments alone or in combination with the afore or aft mentioned embodiments, the die set further includes a positive depth from the lip to the bottom surface so that the bottom surface acts as a travel stop that sets a predetermined position with the free end of the conductor wire extending past the lower face of the electrical connector.

In some embodiments alone or in combination with the afore or aft mentioned embodiments, the positive depth is along an axis defined by the conductor wire and/or is sufficient so that a center of the electrical connector is directly in line along the crimp axis from an indentor post of the indentor die.

In some embodiments alone or in combination with the afore or aft mentioned embodiments, the die set further includes a negative depth from the lip to the bottom surface so that the bottom surface acts as a travel stop that sets a predetermined position with the free end of the conductor wire recessed into the electrical connector with respect to the lower face.

In some embodiments alone or in combination with the afore or aft mentioned embodiments, the negative depth is along an axis defined by the conductor wire and/or is sufficient so that a center of the electrical connector is directly in line along the crimp axis from an indentor post of the indentor die.

In some embodiments alone or in combination with the afore or aft mentioned embodiments, the lip is flush with the bottom surface so that the bottom surface acts as a travel stop that sets a predetermined position with the lower face of the electrical connector flush to the free end of the conductor wire.

In some embodiments alone or in combination with the afore or aft mentioned embodiments, the conductor receipt area is configured so that the conductor wire, when the free end of the conductor wire is abutting the bottom surface, is perpendicular to the crimp axis.

The above-described and other features and advantages of the present disclosure will be appreciated and understood by those skilled in the art from the following detailed description, drawings, and appended claims.

DETAILED DESCRIPTION

Figure 1:
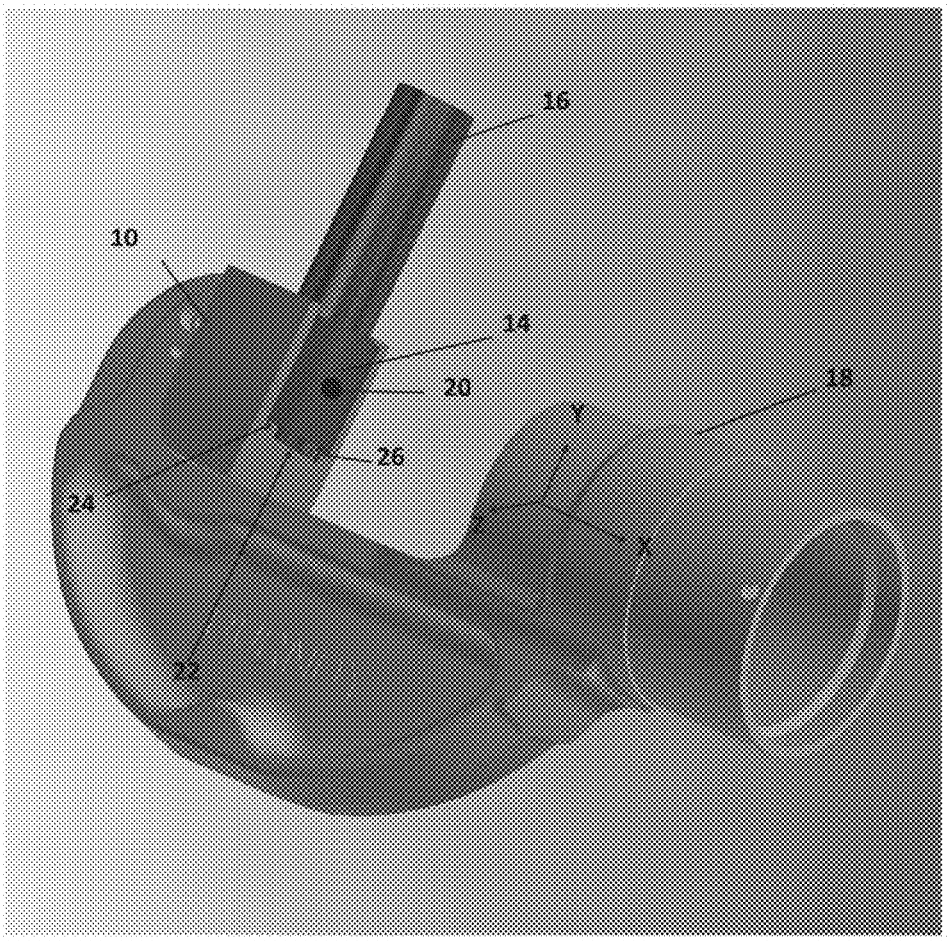
FIG. 1 is a perspective view of a crimp tool in use with an exemplary embodiment of a nest die according to the present disclosure having an electrical connector and a conductor wire disposed therein before crimping.
Figure 2:
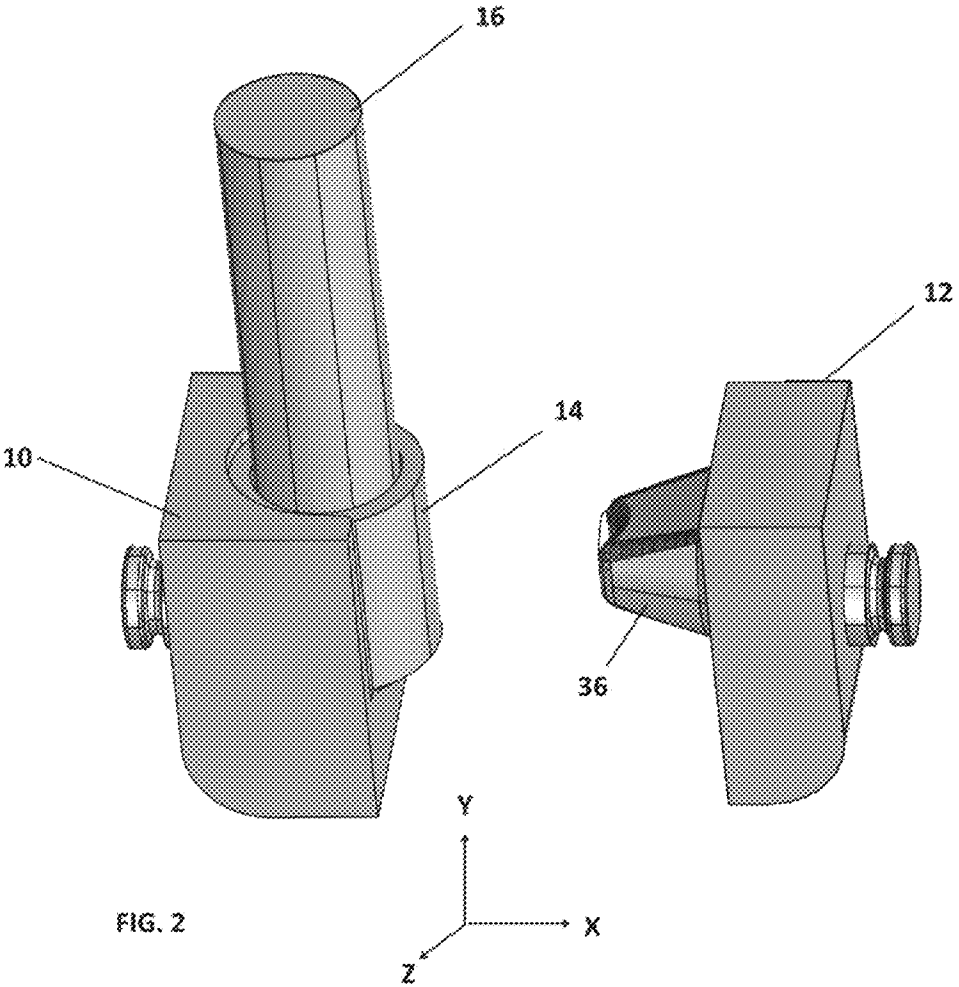
FIG. 2 is a perspective view of the nest die, electrical connector, and conductor wire of FIG. 1 illustrating an exemplary embodiment of an indentor die according to the present disclosure.

Referring to the drawings and in particular to FIGS. 1 and 2, an exemplary embodiment of a nest die and an indentor die according to the present disclosure are shown and are generally referred to by reference numerals 10 and 12, respectively, which together form a crimp die set.

Nest die 10, when used in combination with indentor die 12, is configured to allow the operator to crimp an electrical connector 14 onto a conductor wire 16 using a crimp tool 18. Advantageously, nest die 10 makes it possible to form the crimped connection easier and with more accuracy and reproducibility than previously possible.

Nest die 10 is shown in FIG. 1 in use with crimp tool 18 and in FIG. 2 without the crimp tool for reasons of clarity. In both figures, nest die 10 is illustrated having electrical connector 14 and conductor wire 16 disposed therein before crimping. Additionally, nest die 10 is shown in FIG. 3 before assembly of electrical connector 14 and conductor wire 16 and is shown in FIG. 4 after assembly of the electrical connector and conductor wire.

Nest die 10 is easily and reproducibly seats electrical connector 14 such that indentor die 12 impacts the electrical connector at a predetermined location—such as but not limited to a center 20 of the electrical connector.

Nest die 10 also easily and reproducibly seats electrical connector 14 at a predetermined position on conductor wire 16. The predetermined position is defined as a relationship between a free end 22 of conductor wire 16 and a lower face 24 of electrical connector 14. The predetermined position can be set so that free end 22 extends beyond lower face 24 a desired distance 26.

Figure 3:
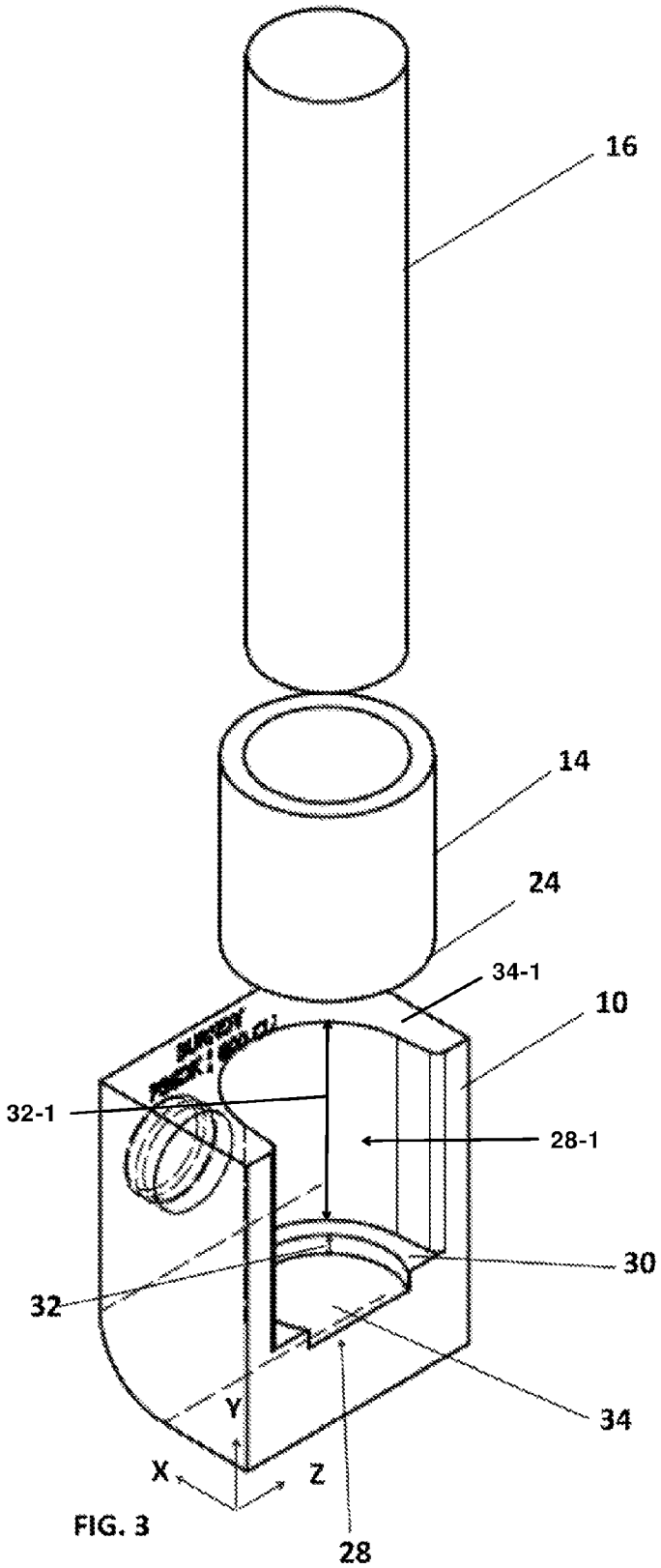
FIG. 3 is a perspective view of the nest die of FIG. 1 before assembly of the electrical connector and conductor wire.
Figure 4:
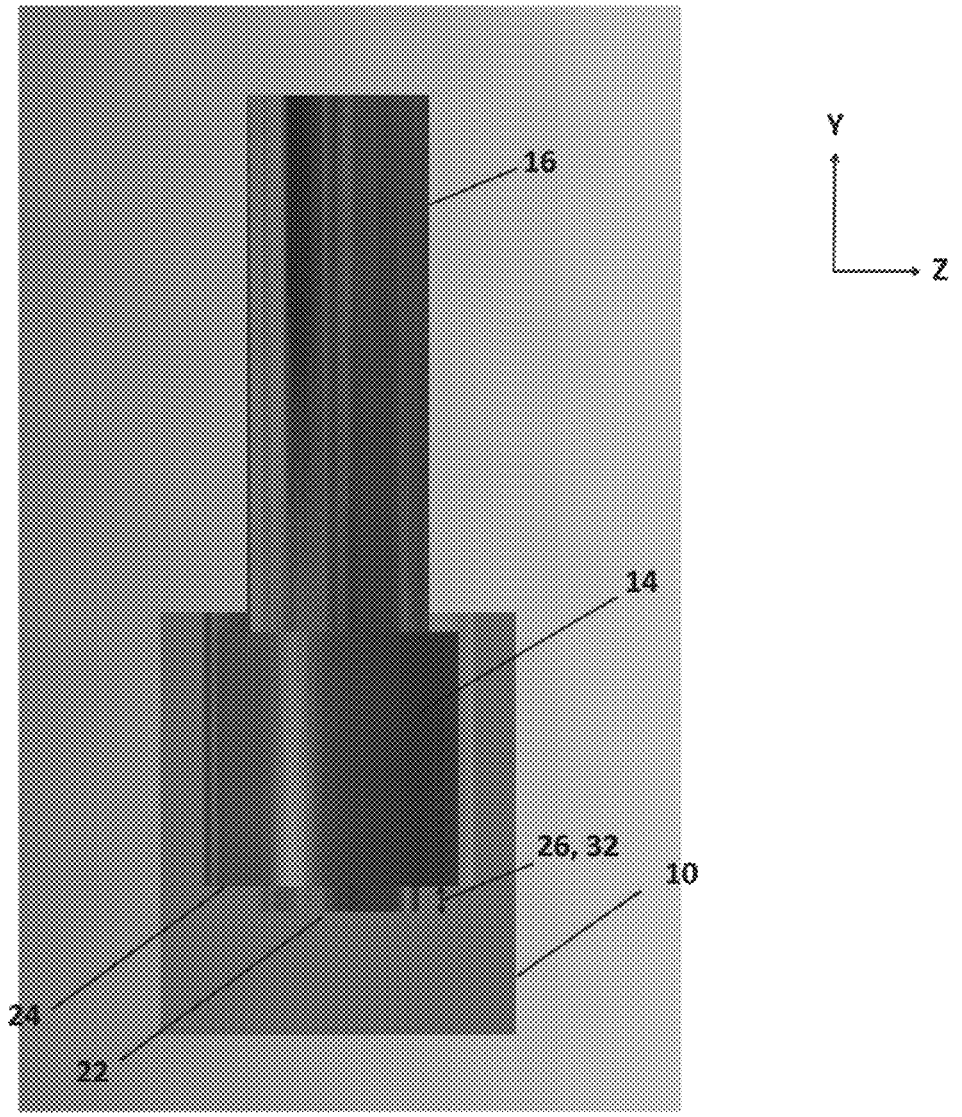
FIG. 4 is a front view of the nest die of FIG. 1 after assembly of the electrical connector and conductor wire.
Figure 5:
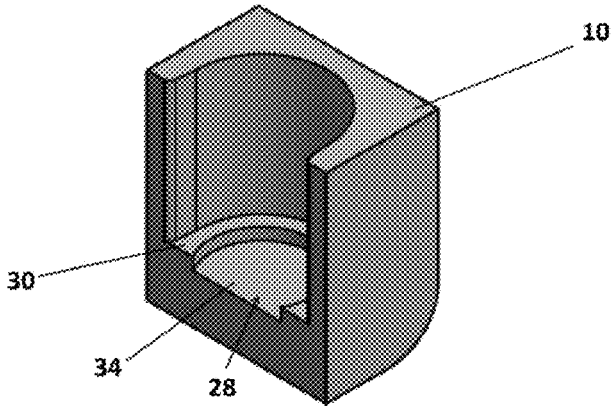
FIG. 5 is a perspective view of an exemplary embodiment of a nest die according to an exemplary embodiment of the present disclosure.
Figure 6:
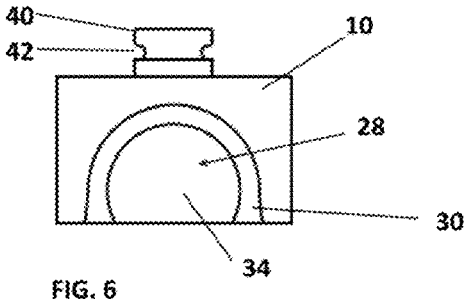
FIG. 6 is a top view of the nest die of FIG. 5.
Figure 7:
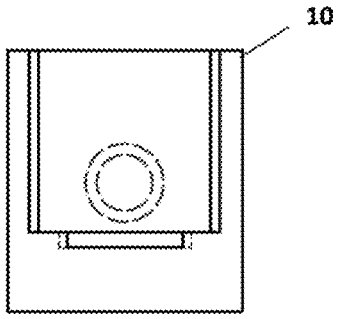
FIG. 7 is a front view of the nest die of FIG. 5.
Figure 8:
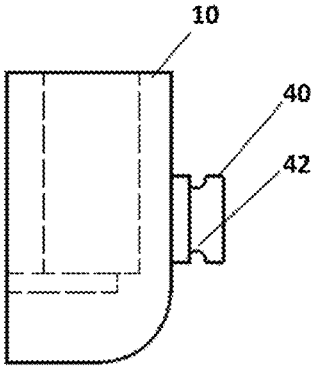
FIG. 8 is a side view of the nest die of FIG. 5.
Figure 9:
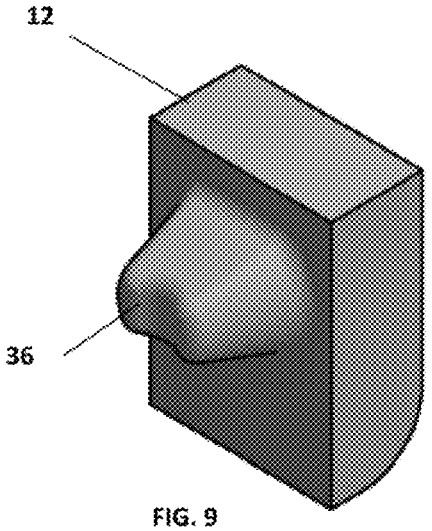
FIG. 9 is a front perspective view of an exemplary embodiment of an indentor die according to an exemplary embodiment of the present disclosure.
Figure 10:
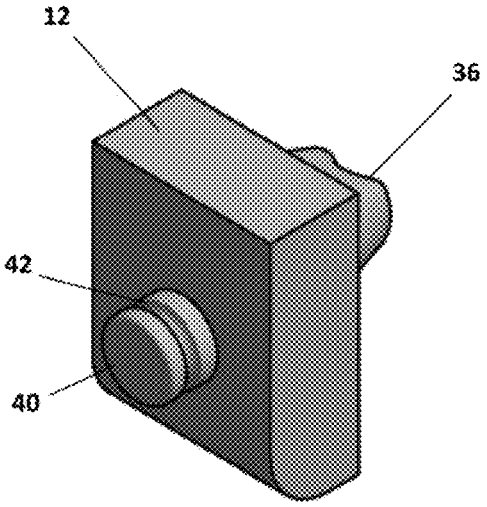
FIG. 10 is a rear perspective view of the indentor die of FIG. 9.
Figure 11:
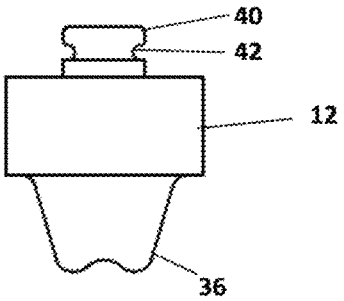
FIG. 11 is a top view of the indentor die of FIG. 9.
Figure 12:
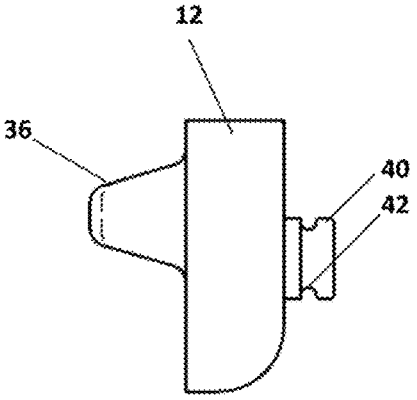
FIG. 12 is a side view of the indentor die of FIG. 9.

In order to provide desired distance 26, nest die 10 includes a conductor receipt area 28 and a connector receipt area 28-1 defining a lip 30 at an outer periphery of the conductor receipt area and an inner periphery of the connector receipt area as shown in FIG. 3. Conductor receipt area 28 has a negative depth 32 along an X-axis from lip 30 to a bottom surface 34, which is equal to desired distance 26. Conversely, connector receipt area 28-1 has a positive depth 32-1 along the X-axis from lip to a top surface 34-1.

In use, electrical connector 14 is positioned in nest die 10 so that lower face 24 is supported by lip 30 with conductor wire 16 passed through the electrical connector 14 until free end 22 is received at area 28 and abuts bottom surface 34. In this manner, nest die 10 acts as a travel stop that sets the predetermined position of electrical connector 14 on conductor wire 16 equal to distance 26/depth 32.

Figure 13:
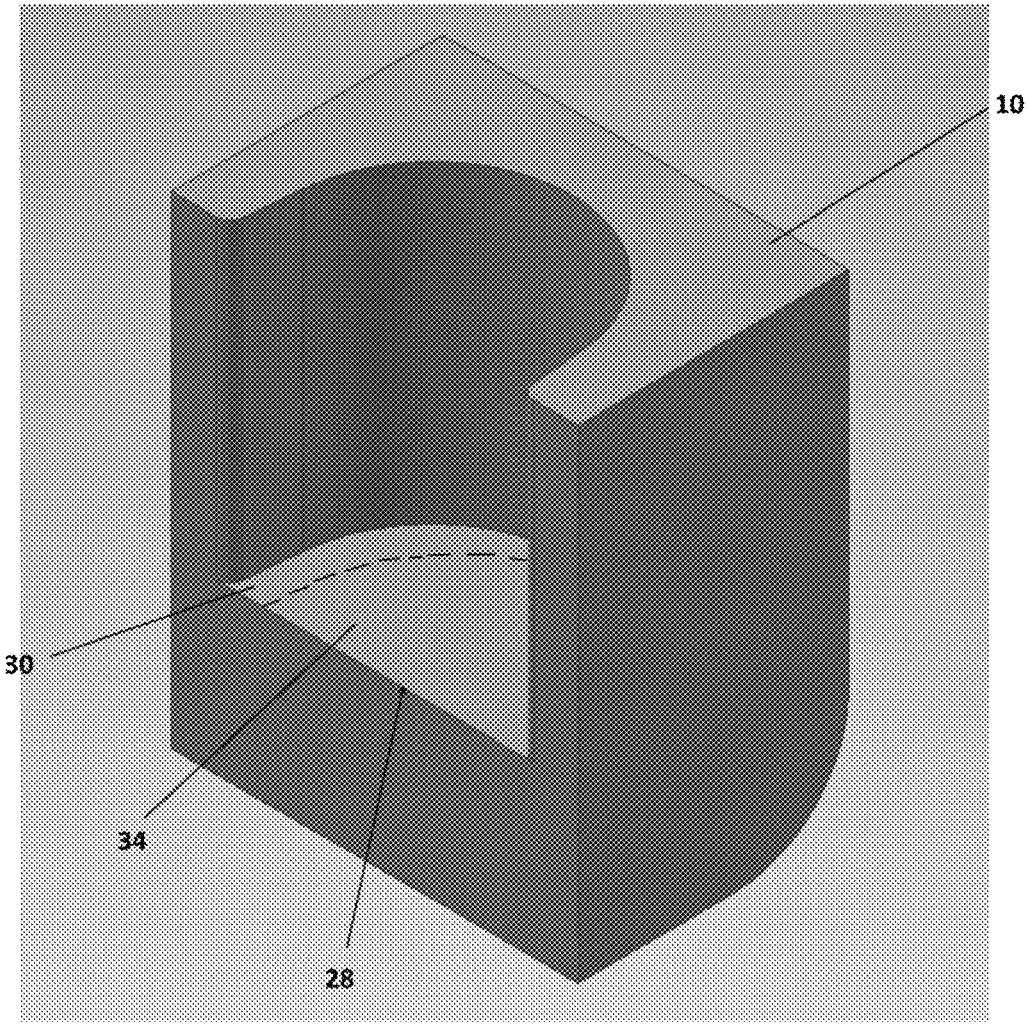
FIG. 13 is front perspective view of an alternate exemplary embodiment of a nest die according to an exemplary embodiment of the present disclosure with a flush conductor receipt area.

Of course, it should be recognized that nest die 10 can be configured so that the predetermined position is any desired position. For example, in some embodiments nest die 10 is configured so that free end 22 is flush or planar with lower face 24 as shown in FIG. 13. Here, depth 32 is equal to zero such that area 28 and lip 30 are flush or coplanar with one another. For purposes of clarity, lip 30 and bottom surface 34 have been demarcated by a dotted line.

Figure 14:
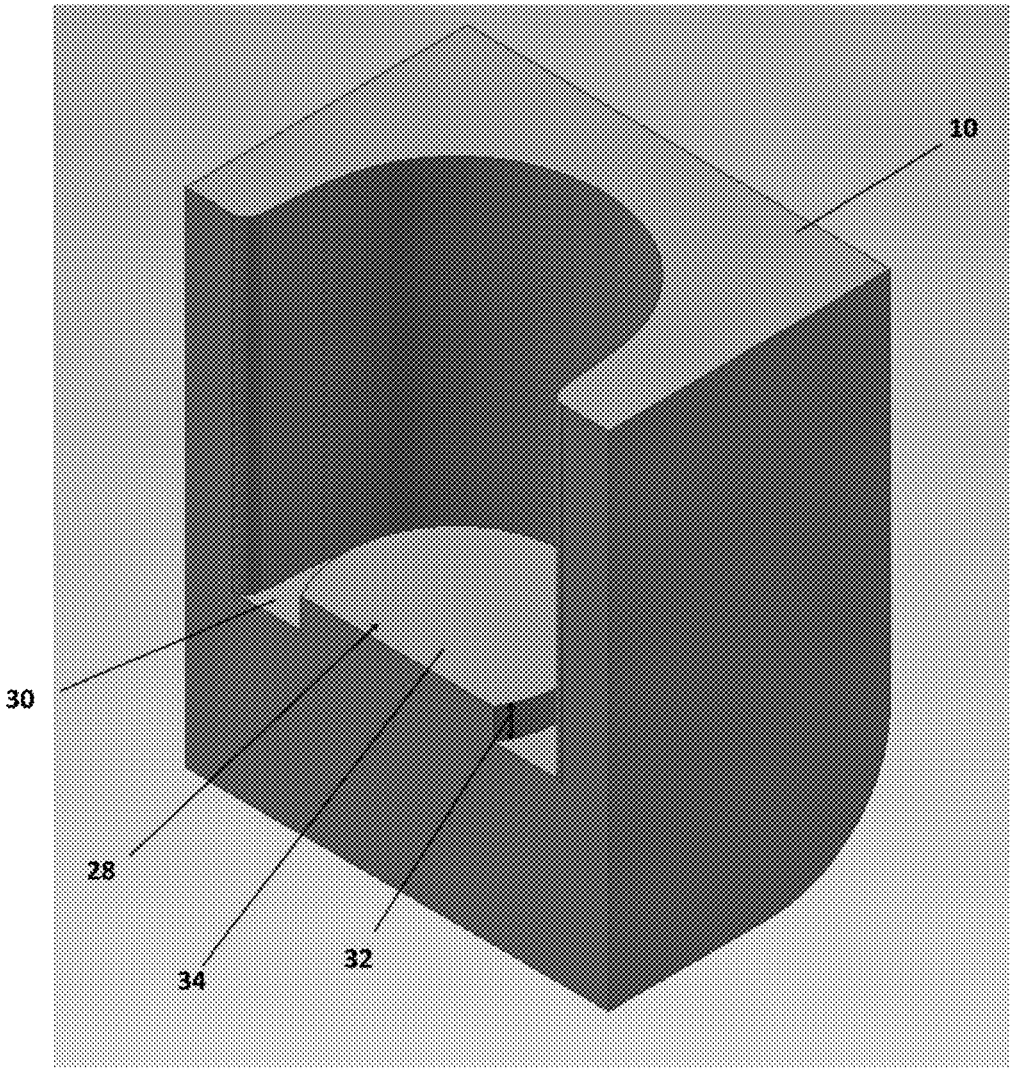
FIG. 14 is front perspective view of another alternate exemplary embodiment of a nest die according to an exemplary embodiment of the present disclosure with a protruding conductor receipt area.

In other embodiments, nest die 10 is configured so that free end 22 is recessed with respect to lower face 24 as shown in FIG. 14. Here, area 28 extends upwards from bottom surface 34 so that lip 30 is below the bottom surface, namely the area has a positive depth 32 with respect to the bottom surface.

Returning to FIGS. 1 and 2, crimp tool 18 and its use of the tool with nest die 10 will be discussed with respect to a three dimensional Cartesian coordinate system having an X-axis, a Y-axis, and a Z-axis. Crimp tool 18 has a movable piston (not shown) that moves indentor die 12 into nest die 10 along the X-axis, also referred to as a crimp direction.

Nest die 10 is configured so that electrical connector 14 can be inserted into the nest die from either a top position, namely along the Y-axis (i.e., along the axis through conductor wire 16), and/or from a front position, namely along the X-axis.

Electrical connector 14 and conductor wire 16 can be pre-assembled with one another before or after insertion of the electrical connector into nest die 10. When pre-assembled, conductor wire 16 is inserted into recess area 28 along the Y-axis so that free end 22 is on bottom surface 34 and so that lower face 24 of electrical connector 14 on lip 30.

Additionally, conductor wire 16 can be inserted into electrical connector 14 after the electrical connector has been inserted into nest die 10. Here, conductor wire 16 is inserted into through electrical connector 14 so that that free end 22 is on bottom surface 34 and so that lower face 24 of electrical connector 14 on lip 30.

It has been determined by the present disclosure that insertion of conductor wire 16 through electrical connector 14 along the Y-axis assists in seating lower face 24 of the electrical connector on lip 30. In this position, nest die 10 has been sized and configured so that center 20 of electrical connector 14 is directly in line along the X-axis from indentor post 36 of indentor die 12.

Thus, nest die 10 is configured to properly position electrical connector 14 and conductor wire 16 with respect to one another (e.g., due to recessed area 28) and to properly seat electrical connector 14 in an optimal position for crimping—with center 20 positioned inline along the X-axis with indentor post 36. Moreover, nest die 10 provides the aforementioned benefits in a manner that easily performed and is easily reproducible. In short, nest die 10 allows for a unique combination of front or horizontal loading of electrical connector 14 and vertical crimping, where the X-axis is vertically oriented and the Y-axis is horizontally oriented.

Figure 15:
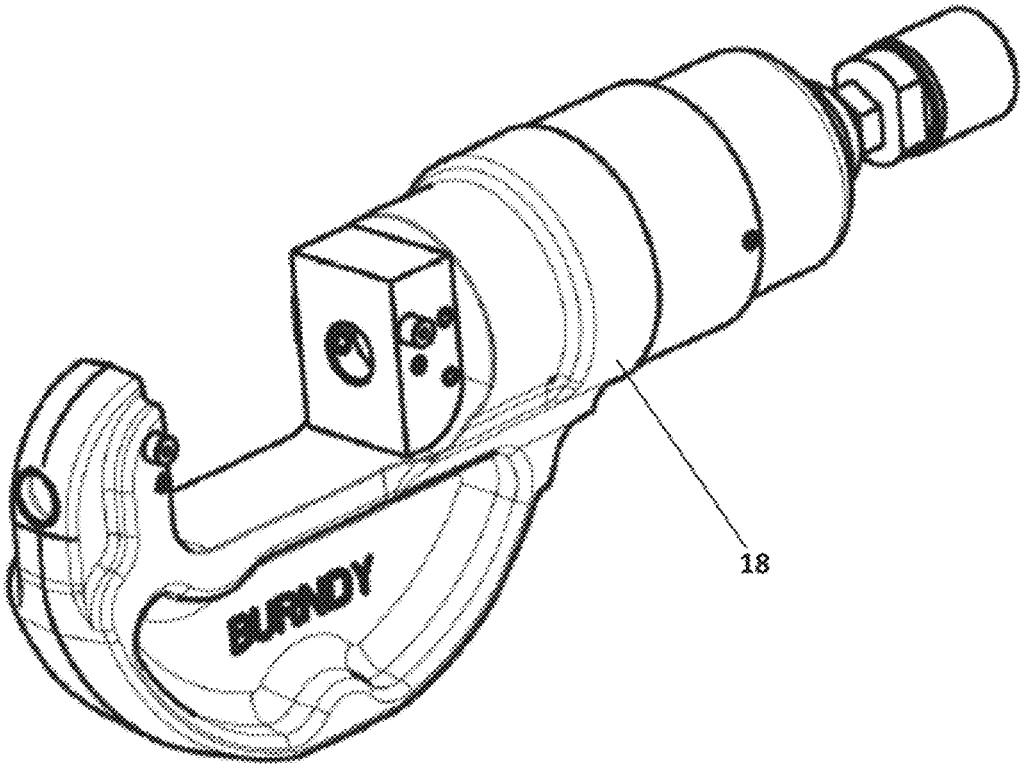
FIG. 15 is a perspective view of an exemplary embodiment of a hand crimp tool for use with the die set of the present application.

Crimp tool 18 can be configured as a hand tool such as, but not limited to, the commercially available BURNDY PAT750K tool as shown in FIG. 15 before installation of nest and indentor dies 10, 12. Alternately, crimp tool 18 can be configured as a bench top or stationary tool such as, but not limited to, the commercially available BURNDY Y750BHK tool (not shown).

Nest and indentor dies 10, 12 are, in some embodiments, compatible for use with one or more commercially available crimp tools 18. For example and as seen in FIGS. 5-12, dies 10, 12 each have a securing portion 40 having an annular groove 42. Securing portion 40 and annular groove 42 allow dies 10, 12 to be secured to crimp tool 18 via a known ball-and-detent system and/or a known set-screw system. Of course, it should be recognized that dies 10, 12 can be permanently or releasably secured to crimp tool 18 in any desired manner.

Indentor die 12, shown in FIGS. 9-12, can have any indentor post 36 with any profile sufficient to deform electrical connector 14 to a desired shape.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A nest die for mechanically securing an electrical connector to a conductor wire using a crimp tool with a crimp axis, comprising:

a conductor receipt area having an outer periphery and a bottom surface;

a lip at the outer periphery of the conductor receipt area, the outer periphery being sufficient to receive a free end of the conductor wire abutting the bottom surface and a lower face of the electrical connector on the lip; and a connector receipt area extending from the lip along an axis defined by the conductor wire and extending around the outer periphery of the conductor receipt area so that the electrical connector is received in the connector receipt area.

2. The nest die of claim 1, wherein the conductor receipt area is configured so that the electrical connector can be loaded and unloaded from the conductor receipt area along the crimp axis and along the axis defined by the conductor wire.

3. The nest die of claim 1, further comprising a positive depth from the lip to the bottom surface so that the bottom surface acts as a travel stop that sets a predetermined position with the free end of the conductor wire extending past the lower face of the electrical connector.

4. The nest die of claim 3, wherein the positive depth is along the axis defined by the conductor wire.

5. The nest die of claim 3, wherein the positive depth is sufficient so that a center of the electrical connector is directly in line with the crimp axis.

6. The nest die of claim 1, further comprising a negative depth from the lip to the bottom surface so that the bottom surface acts as a travel stop that sets a predetermined position with the free end of the conductor wire recessed into the electrical connector with respect to the lower face.

7. The nest die of claim 6, wherein the negative depth is along the axis defined by the conductor wire.

8. The nest die of claim 6, wherein the negative depth is sufficient so that a center of the electrical connector is directly in line with the crimp axis.

9. The nest die of claim 1, wherein the lip is flush with the bottom surface so that the bottom surface acts as a travel stop that sets a predetermined position with the lower face of the electrical connector flush to the free end of the conductor wire.

10. The nest die of claim 1, wherein the conductor receipt area is configured so that the conductor wire, when the free end of the conductor wire is abutting the bottom surface, is perpendicular to the crimp axis.

11. An indent crimp die set for mechanically securing an electrical connector to a conductor wire using a crimp tool having a crimp direction, comprising:

a nest die including a conductor receipt area, a connector receipt area, and a lip, the conductor receipt area having an outer periphery and a bottom surface, the connector receipt area having an inner periphery and a top surface, the lip being defined at the outer periphery of the conductor receipt area and an inner periphery of the connector receipt area, the outer periphery being sufficient to receive a free end of the conductor wire abutting the bottom surface and a lower face of the electrical connector on the lip; and an indentor die.

12. The die set of claim 11, wherein the conductor receipt area is configured so that the electrical connector can be loaded and unloaded from the conductor receipt area along the crimp axis and along an axis defined by the conductor wire.

13. The die set of claim 11, further comprising a positive depth from the lip to the bottom surface so that the bottom surface acts as a travel stop that sets a predetermined position with the free end of the conductor wire extending past the lower face of the electrical connector.

14. The die set of claim 13, wherein the positive depth is along an axis defined by the conductor wire.

15. The die set of claim 13, wherein the positive depth is sufficient so that a center of the electrical connector is directly in line along the crimp axis from an indentor post of the indentor die.

16. The die set of claim 11, further comprising a negative depth from the lip to the bottom surface so that the bottom surface acts as a travel stop that sets a predetermined position with the free end of the conductor wire recessed into the electrical connector with respect to the lower face.

17. The die set of claim 16, wherein the negative depth is along an axis defined by the conductor wire.

18. The die set of claim 16, wherein the negative depth is sufficient so that a center of the electrical connector is directly in line along the crimp axis from an indentor post of the indentor die.

19. The die set of claim 11, wherein the lip is flush with the bottom surface so that the bottom surface acts as a travel stop that sets a predetermined position with the lower face of the electrical connector flush to the free end of the conductor wire.

20. The die set of claim 11, wherein the conductor receipt area is configured so that the conductor wire, when the free end of the conductor wire is abutting the bottom surface, is perpendicular to the crimp axis.

* * * * *